US008042475B2

(12) United States Patent
Larcom et al.

(10) Patent No.: US 8,042,475 B2
(45) Date of Patent: Oct. 25, 2011

(54) TABLE

(75) Inventors: Larry Larcom, Roy, UT (US); Ju-Young Jin, Xiamen Fujian (CN)

(73) Assignee: Lifetime Products, Inc, Clearfield, UT (US)

( * ) Notice: Subject to any disclaimer, the term of this patent is extended or adjusted under 35 U.S.C. 154(b) by 662 days.

(21) Appl. No.: 12/042,310

(22) Filed: Mar. 4, 2008

(65) Prior Publication Data

US 2008/0223263 A1 Sep. 18, 2008

Related U.S. Application Data

(60) Provisional application No. 60/893,096, filed on Mar. 5, 2007.

(51) Int. Cl.
*A47B 3/00* (2006.01)

(52) U.S. Cl. ..... 108/130; 108/901

(58) Field of Classification Search ..... 108/115, 108/129–133, 901, 161; 248/188, 188.1, 248/188.6

See application file for complete search history.

(56) References Cited

U.S. PATENT DOCUMENTS

| | | | | |
|---|---|---|---|---|
| 6,058,853 | A * | 5/2000 | Pinch | 108/129 |
| 6,371,034 | B1 * | 4/2002 | Simpson et al. | 108/129 |
| D489,557 | S * | 5/2004 | Strong et al. | D6/511 |
| 6,732,663 | B2 * | 5/2004 | Tsai | 108/132 |
| 6,823,806 | B1 * | 11/2004 | Buono | 108/132 |
| 7,178,471 | B2 * | 2/2007 | Strong et al. | 108/132 |
| 7,299,754 | B2 * | 11/2007 | Stanford et al. | 108/132 |
| 7,428,872 | B2 * | 9/2008 | Strong et al. | 108/132 |
| 7,621,224 | B2 * | 11/2009 | Lin et al. | 108/132 |
| 7,752,982 | B2 * | 7/2010 | Lin | 108/168 |
| 2002/0092444 | A1 | 7/2002 | Stanford | |
| 2003/0005864 | A1 * | 1/2003 | Wen | 108/132 |
| 2005/0241550 | A1 | 11/2005 | Neunzert et al. | |
| 2007/0039526 | A1 | 2/2007 | Yang | |

(Continued)

FOREIGN PATENT DOCUMENTS

| | | | |
|---|---|---|---|
| CN | 1638675 | A | 7/2005 |
| CN | 1669503 | A | 9/2005 |

OTHER PUBLICATIONS

International Preliminary Report on Patentability, dated Sep. 17, 2009, 6 pages.

(Continued)

*Primary Examiner* — Janet M Wilkens

(74) *Attorney, Agent, or Firm* — Maschoff Gilmore & Israelsen, PLLC

(57) ABSTRACT

A table may include a table top, a frame and one or more legs that may be movable between extended and collapsed positions relative to the table top. Advantageously, the table top may include a generally planar upper surface and a generally planar lower surface. The lower surface of the table top, however, may include a first lip disposed proximate a first end of the table top and a second lip disposed proximate a second end of the table top. The lower surface may also include mounting members that are sized and configured to allow a frame to be connected to the table top. Desirably, the mounting members allow side rails of a frame to be attached to the table top and at least a portion of the side rails are disposed between the first and second lips. This may allow at least a portion of the frame to be exposed and visible when the table is being used.

20 Claims, 7 Drawing Sheets

U.S. PATENT DOCUMENTS

2007/0199483 A1* 8/2007 Peery et al. ..... 108/132

OTHER PUBLICATIONS

International Search Report and Written Opinion from PCT/US2008/055876, dated Aug. 7, 2008, 11 pages.

Office Action dated Jan. 24, 2011 from Chinese Patent Application No. 20080000061.0.

Office Action dated Jan. 24, 2011 from Chinese Patent Application No. 20080000061.0, unverified English translation.

* cited by examiner

TABLE

CROSS-REFERENCE TO RELATED APPLICATIONS

This application claims priority to and the benefit of U.S. provisional patent application Ser. No. 60/893,096, filed on Mar. 5, 2007, which is incorporated by reference in its entirety.

BACKGROUND OF THE INVENTION

1. Field of the Invention

The present invention generally relates to furniture and, in particular, to tables.

2. Description of Related Art

Conventional tables are used for a variety of purposes and come in a wide array of designs. Conventional tables often include table tops that are constructed from materials such as wood, particle board or metal. Table tops constructed from wood, particle board or metal, however, are often relatively heavy and this may make the table awkward or difficult to move. Table tops constructed from wood or metal are also relatively expensive and these types of table tops must generally be treated or finished before use. For example, table tops constructed from wood must generally be sanded and painted, and metal table tops must be formed into the desired shape and painted. In addition, these relatively heavy table tops may increase the cost of shipping, transportation and/or storage of the tables.

In order to decrease the weight of conventional tables, it is known that table tops can be constructed from relatively light-weight materials such as plastic. Disadvantageously, these light-weight table tops frequently require reinforcing members or other structural parts such as braces, brackets, support members and the like to strengthen the table top. While these additional parts may increase the strength of the table top, the additional parts may also increase the weight of the table. In addition, these additional parts may increase manufacturing costs and require additional time to assemble the table. For example, additional fasteners may be required to connect these additional parts to the table, which may require extra time and labor during the manufacturing process. The additional parts and fasteners may also increase the cost of the table and make the table more difficult to manufacture. Furthermore, these additional parts may have sharp edges that can injure the user's legs, arms or other body parts.

Conventional tables often include legs that are sized and configured to support the table top about a surface, such as the floor or ground, and a frame that is connected to the table top. The frame may include a pair of side rails that are connected to the sides of the table top using fasteners. It is also known to connect the side rails of the frame to an outer peripheral lip of the table top. In particular, it is known to use fasteners to attach the frame to the lip by inserting fasteners through the side rails and into the lip.

Unfortunately, when excessive forces or loads are applied to such tables, the fasteners may allow the frame to detach or separate from the table top. In addition, if the table top is constructed from plastic, the fasteners can damage and even tear through the table top if the load or force exceeds a certain amount. Moreover, the side rails and frames of some conventional tables may have lower strength and/or structural integrity, which may allow the table to undesirably break or collapse.

BRIEF SUMMARY OF EMBODIMENTS OF THE INVENTION

A need therefore exists for a table that eliminates or diminishes the above described and/or other disadvantages and problems.

One aspect is a table that may include a table top and one or more legs that are sized and configured to support the table top above a support surface such as the floor or ground. The table may also include a frame and legs may be connected to the frame. The legs may be movable relative to the table top between a collapsed or storage position and an extended or use position. In particular, the legs may be pivoted between a collapsed position in which the legs are disposed at least proximate the lower surface of the table top, and an extended position in which the legs extend outwardly from the table top. If desired, the legs may at least partially contact or abut the lower surface of the table top when the legs are in the collapsed position. In addition, the table top may include one or more recesses that are sized and configured to receive at least a portion of the legs when the legs are in the collapsed position. Advantageously, this may decrease the amount of space required to store and/or ship the table.

Another aspect is a table that may be relatively lightweight, which may allow the table to be more easily transported and moved. For example, the table may include a lightweight table top that reduces the overall weight of the table. The table may also include a lightweight frame that is connected to the table top. In addition, the table may include lightweight legs that support the table top above a surface. Significantly, if the table includes a lightweight table top, frame and/or legs, then a lightweight table to be constructed. In addition, the table may be constructed from a limited number of parts or components, which may further reduce the weight of the table. Further, a limited number of fasteners may be required to assemble the table, which may also reduce the weight of the table.

Yet another aspect is a table that may include a table top constructed from a lightweight material such as blow-molded plastic. Advantageously, the lightweight table top may allow a table to be created that is easily portable and can be readily lifted and moved by a single person. The blow-molded plastic table top may provide a rigid, high-strength structure that is capable of withstanding repeated use and wear. In addition, the blow-molded table top may be easily manufactured and formed into the desired size and shape.

Significantly, a blow-molded plastic table top may be quickly and efficiently manufactured. For example, the blow-molded table top may include two opposing walls that are spaced apart a generally constant and/or predetermined distance, which may increase the strength and rigidity of the table top. The blow-molded table top may also include one or more depressions or tack-offs, and the depressions may be designed to increase the strength of the table top and/or interconnect the spaced apart walls. In addition, the blow-molded table top may be light-weight, durable, generally weather resistant and temperature insensitive. Further, the blow-molded table top may not corrode, rust or otherwise deteriorate over an extended period of time, which may help create a long lasting table. The blow-molded plastic table top can also be relatively easily formed into various shapes, sizes, configurations and designs.

Still another aspect is a table that may include a frame which is connected to the table top in several discrete locations. For example, the frame is preferably connected to separate structures, such as projections or mounting members, that extend downwardly from the lower surface of the table top and are spaced apart a given distance. The frame may be connected to the discrete structures by fasteners, such as screws. The projections are preferably independent of and spaced apart from other structures, such as a peripheral lip. If desired, the projections may be disposed towards an inner portion of the table and the frame may be disposed towards the outer portion of the table, and the frame may be connected to the projections in a manner such that the fasteners are hidden from view when the table is being used. In particular, the fasteners may be inserted through the projections and into an inner portion of the frame so that the fasteners are generally not visible when the table is being used. Advantageously, the projections may be integrally formed with the table top during the blow-molding process.

A further aspect is a table that may include legs that have a width substantially equal to a width of the table top. For example, if the frame is connected to the table top by distinct projections, then the legs may have a width approximately equal to a width of the table top because no structures, such as a downwardly extending lip, may decrease the width of the legs. In addition, if desired, the spaced apart projections may allow the frame to be attached to the outer edges of the table top and that may allow wider table legs to be used in connection with the table. For instance, the table may include two side rails that are disposed along the sides of the table and the table legs may be disposed between the side rails when the legs are in the collapsed position. Advantageously, because the side rails may be disposed along the edges of the table top, the legs may have a width that is approximately equal to or slightly less than the width of the table top. Thus, the legs could include two support portions that are disposed proximate the edges of the table and the support portions could be separated by a distance that is approximately equal to or slightly smaller than the width of the table top. The legs could also have a foot or feet that are approximately equal to or slightly smaller than the width of the table top. Advantageously, because the legs may have a width that is approximately equal to the width of the table top, that may allow a sturdy and stable table to be created.

A still further aspect is a table that may include a frame and at least a portion of the frame may be exposed to the user. For example, the frame may include side rails that extend along at least a portion of the length of the table. Desirably, the frame includes two side rails that are disposed along opposing edges or sides of the table. In particular, the side rails may be generally aligned with the sides of the table or the side rails may be spaced inwardly from the sides of the table to allow the edge of the table top to be grasped or held. This may allow the table to be easily moved or transported. The frame may also include one or more portions, such as end rails, that are disposed along the ends of the table top. Thus, the frame may be disposed about the perimeter or outer edges of the table.

Still another further aspect is a table that may include side rails that are at least partially exposed. For example, the table may include a table top with outer edges and the side rails may be disposed along the outer edges. In particular, the side rails may include an outwardly facing side that is at least partially exposed when the table is being used and an inwardly facing side. The inwardly facing side may be connected to mounting structures, if desired. The outwardly facing side of the side rail is preferably disposed proximate to and faces towards an outer edge of the table top, while the inwardly facing side of the side rail preferably faces towards a central portion of the table top. If desired, at least a portion of the outwardly facing side of the side rail may be exposed such that it may be visible when viewing the table from the side. The side rail may even be exposed if the table top includes a downwardly extending lip. For example, if the table includes a generally downwardly extending lower lip, then a portion of the lip may be removed, omitted or have a different size to allow at least a portion of the side rail to be exposed. It will be appreciated that the side rail does not have to be exposed and the table does not require a lip or other such structure.

Advantageously, if at least a portion of the frame is exposed, then that may indicate to the user or purchaser that the table has increased strength and/or rigidity when compared to a conventional table. That is, the exposed frame may create a perception of a stronger table. In addition, if the frame is disposed along the outer edges of the table top, then the frame may provide increased support for the edges or extremities of the table top. Therefore, the frame may be used to create a stronger and/or more rigid table. Further, if the frame is disposed along the outer edges of the table top, then the frame may help prevent the table top from being damaged. For example, the frame may absorb impacts or forces because it is disposed about the perimeter of the table top that otherwise would be applied directly to the table top. Accordingly, the frame may also help protect the table top from being dented, damaged or broken.

In addition, if at least a portion of the frame is exposed, that may create a table with improved aesthetics and style. For example, the exposed frame may provide a color contrast with the table top. That is, the table top may be one color and the frame may have a different color in order to create a table with a stylized appearance.

Another aspect is a table that may include a table top with a generally planar lower surface. For example, the table may include a table top that does not include a generally downwardly extending portion or lip that may be used to attach the frame to the table top. This may make the table top easier to manufacture if it does not include any downwardly extending projections. In addition, it may decrease the amount of plastic or other material used to create the table top. The table, however, could include structures that extend beyond the generally planar lower surface, such as projections or mounting members that are sized and configured to facilitate attachment of a frame to the table top. The table top could also include structures that extend upwardly and towards the upper surface of the table top, such as depressions or tack-offs.

Yet another aspect is a table that may include a table top with receiving portions that are sized and configured to receive a portion of the frame. For example, the frame may include side rails and the receiving portions may be sized and configured to receive at least a portion of the side rails. In greater detail, the side rails may have curved upper surfaces and the lower surface of the table top may include generally matching receiving portions with curved surfaces that are sized and configured to receive the upper portion of the frame. For instance, the table top may include generally concave receiving portions that are sized configured to receive generally convex upper portions of the side rails. Desirably, if the table top is constructed from blow-molded plastic, then the receiving portions may be integrally formed in the table top during the blow-molding process as part of a unitary, one-piece construction. Significantly, if the receiving portions are integrally formed as part of the table top, then the table top may have increased strength and/or structural integrity.

Advantageously, the side rails and/or receiving portions could have a variety of suitable configurations and arrangements. For example, the side rails could have a hollow, tubular configuration with a generally circular cross-sectional configuration. The receiving portions could have a corresponding configuration that is sized and configured to receive at least a portion of the side rails. The side rails could also have a generally rectangular configuration with two generally parallel side walls and a generally flat or planar bottom surface. The upper surface of the side rails preferably has a curved, arched and/or convex configuration. The generally rectangular configuration and/or generally flat bottom surface may help increase the strength and/or structural integrity of the side rails. It will be appreciated that the side rails and/or the receiving portions may have other suitable shapes, sizes, configurations and/or arrangements depending, for example, upon the intended use of the table.

Still another aspect is a table that may have a generally planar upper surface and a generally planar lower surface. Preferably the upper surface and the lower surface are spaced apart by a generally constant distance and the upper and lower surface are disposed in a generally parallel configuration.

A further aspect is a table that may include a table top with receiving portions that are sized and configured to receive at least a portion of a frame and mounting structures that are sized and configured to facilitate mounting of the frame to the table top. The receiving portions preferably extend inwardly from a lower surface of the table top and the mounting structures preferably extend outwardly from the lower surface of the table top. In greater detail, if a plane is generally aligned with the lower surface of the table top, then the mounting structures are preferably at least substantially disposed on one side of the plane and the receiving portions are at least substantially disposed on the other side of the plane.

Yet another further aspect is a table that may include various structures that are integrally formed as part of the table top. For example, if the table top is constructed from blow-molded plastic, then the mounting structures may be integrally formed in the table top during the blow-molding process as part of a unitary, one-piece structure. The mounting structures may include a first wall, a spaced apart second wall and a hollow interior portion disposed between the side walls. The hollow interior portion of the mounting structures is preferably in communication with a hollow interior portion of the table top. Significantly, the mounting structures may allow a table frame to be securely connected to the table top. For instance, when the frame is connected to the table top by the mounting structures, one or more fasteners may extend through the sides walls of the mounting structure and into a side rail of the frame. By extending the fasteners through both of the spaced apart walls of the mounting structure, the frame may be securely connected to the table top. In addition, the walls of the mounting structures may be damage resistant. For instance, the fasteners may be less likely to damage the walls of the mounting structure that other portions of the table top. Further, the fasteners are less like to tear through and/or deform the two side walls of the mounting structure. It will be appreciated that the mounting structures do not have to be formed integrally with the table top and may comprise separate structures that may be connected to the table top. It will also be appreciated that the mounting structures and the table top may be formed using other suitable molding and manufacturing processes.

Another aspect is a table that may include a foot that is connected to table leg or leg assembly by a snap, friction and/or interference fit. Advantageously, if the foot is connected to the leg using a snap, friction and/or interference fit, then the foot need not be connected to the leg by fasteners, which may help reduce the manufacturing costs of the table. It will be appreciated, however, that the foot may be connected to the leg assembly using fasteners, adhesives and/or other suitable structures or means.

Still another aspect is a table that may include legs or leg assemblies with a generally U-shaped configuration. For example, the leg assembly may include two generally parallel, elongated portions that are connected to the table top and a connecting portion connecting the elongated portions. The elongated portions preferably have a generally straight configuration and the connecting portion may have a generally straight or curved configuration. The table may also include a foot that is connected to the elongated portion and/or connecting portion, which may help the foot from undesirably moving. In addition, at least a part of the foot may extend beneath and/or past the elongated portions, which may increase the stability of table by, for example, creating a wider leg assembly. It will be appreciated that the table and leg assemblies may also have other suitable configurations. For example, the table may include two feet that are connected to a leg assembly with a generally U-shaped configuration including two generally upright portions, a generally level intermediate portion and curved portions extending between the generally upright portions and the generally level intermediate portion.

Yet another aspect is a table that may include a foot with a plurality of walls. In particular, the foot may include a pair of spaced apart walls to define a receiving portion that is sized and configured to receive and/or retain at least a portion of a leg assembly fusing a snap fit, a friction fit and/or interference fit. The walls may include one or more recesses (such as notches), which may be sized and configured to relieve stress applied to the walls as the receiving portion receives the leg assembly. Advantageously, this may help prevent the walls from cracking and/or breaking.

A further aspect is a table that may include a frame that and leg assemblies that are constructed from metal, such as steel. At least a portion of the frame and/or leg assemblies are also preferably constructed from generally hollow members and the members may have a generally circular cross-sectional configuration. It will be appreciated, however, that the side rails and leg assemblies may be constructed from other suitable materials and may have a variety of other suitable shapes and/or configurations.

A still further aspect is the table may be relatively straightforward to assemble. Advantageously, this may allow the table to be quickly and easily manufactured. In addition, this may allow the table to be shipped in an unassembled configuration and the consumer may be able to assemble the table. This may allow manufacturing and shipping costs to be decreased.

Yet another further aspect is the table may include components that can be quickly and easily manufactured. For example, the lower portion of the table top may have a generally planar construction, which may simplify the manufacturing process and allow the table top to be quickly and easily manufactured. In addition, the legs and/or frame may be quickly and easily attached to the table top, which may reduce manufacturing costs. The table may also be constructed from only a few parts and a limited number of fasteners, which may allow the table to be quickly and easily assembled by the manufacturer, retailer and/or consumer. For example, the table may be constructed entirely from a table top, two side rails, two leg assemblies and a handful of fasteners. In particular, four or eight fasteners may be used to attach the leg assemblies to the side rails and that may allow the table to be completely assembled. Other components, such as feet, may also be attached to the table if desired.

Another aspect is a table that may comprise a table top including a first side, a second side, a first end, a second end, an upper surface and a lower surface; a first plane generally aligned with the upper surface of the table top; a second plane generally aligned with the lower surface of the table top, the first plane and the second plane being disposed in generally parallel planes and spaced apart by a generally constant distance; a first leg disposed proximate the first end of the table top, the first leg being movable between an extended position and a collapsed position relative to the table top; a second leg disposed proximate the second end of the table top, the second leg being movable between an extended position and a collapsed position relative to the table top; a first lip extending downwardly from the lower surface of the table top, the first lip being disposed proximate the first end of the table top; a second extending downwardly from the lower surface of the table top, the second lip disposed proximate the second end of the table top; and a frame including a first side rail disposed proximate the first side of the table top and a second side rail disposed proximate the second side of the table top, the first side rail being disposed between the first lip and the second lip, the second side rail being disposed between the first lip and the second lip.

If desired, the table may further comprise a first frame receiving portion disposed in the lower surface of the table top, the first frame receiving portion being sized and configured to receive at least a portion of the first side rail; and a second frame receiving portion disposed in the lower surface of the table top, the second frame receiving portion being sized and configured to receive at least a portion of the second side rail. In addition, the first frame receiving portion may have a generally inwardly extending curved surface; and the second frame receiving portion may have a generally inwardly extending curved surface. The first side rail may also include a curved upper surface and the second side rail may include a curved upper surface. Additionally, the table may comprise a first frame receiving portion disposed in the lower surface of the table top, the first frame receiving portion including a curved surface that generally matches the curved upper surface of the first side rail, the first frame receiving portion being sized and configured to receive the curved upper surface of the first side rail; and a second frame receiving portion disposed in the lower surface of the table top, the second frame receiving portion including a curved surface that generally matches the curved upper surface of the second side rail, the second frame receiving portion being sized and configured to receive the curved upper surface of the second side rail.

Advantageously, the table may include a first lip with a generally C-shaped configuration with a first portion disposed proximate the first side of the table top, a central portion disposed proximate the first end of the table top and a second portion disposed proximate the second side of the table top; and a second lip with a generally C-shaped configuration with a first portion disposed proximate the first side of the table top, a central portion disposed proximate the second end of the table top and a second portion disposed proximate the second side of the table top. The table may further comprise a first opening disposed between the first lip and the second lip on the first side of the table top; and a second opening disposed between the first lip and the second lip on the second side of the table top. The first side rail may be disposed proximate the first opening and an outer surface of the first side rail is generally visible to a user when the table is being used; and the second side rail may be disposed proximate the second opening and an outer surface of the second side rail is generally visible to a user when the table is being used. If desired, the table may additionally include a first plurality of mounting members extending downwardly from the lower surface of the table top, the first plurality of mounting members being disposed proximate the first side of the table top, the first plurality of mounting members being sized and configured to allow the first side rail to be attached to the table top, the first plurality of mounting members being independent from and distinct from other portions of the table top; and a second plurality of mounting members extending downwardly from the lower surface of the table top, the second plurality of mounting members being disposed proximate the second side of the table top, the second plurality of mounting members being sized and configured to allow the second side rail to be attached to the table top, the second plurality of mounting members being independent from and distinct from other portions of the table top.

Still another aspect is a table that may comprise a table top including a first side, a second side, a first end, a second end, an upper surface and a lower surface; a first leg disposed proximate the first end of the table top, the first leg being movable between an extended position and a collapsed position relative to the table top; a second leg disposed proximate the second end of the table top, the second leg being movable between an extended position and a collapsed position relative to the table top; at least two first mounting members extending downwardly from the lower surface of the table top, the first mounting members being disposed towards the first side of the table top, the first mounting members being independent from and distinct from other portions of the table top, the first mounting members comprising a first side wall, a second side wall and outer wall disposed between the first side wall and the second side wall; at least two second mounting members extending downwardly from the lower surface of the table top, the second mounting members being disposed towards the second side of the table top, the second mounting members being independent from and distinct from other portions of the table top, the second mounting members comprising a first side wall, a second side wall and an outer wall disposed between the first side wall and the second side wall; a first side rail connected to the first mounting members, the first side rail being disposed proximate the first side of the table top; and a second side rail connected to the second mounting members, the second side rail disposed proximate the second side of the table top.

The table may further comprise a first lip extending downwardly from the lower surface of the table top, the first lip being disposed proximate the first end of the table top; and a second extending downwardly from the lower surface of the table top, the second lip disposed proximate the second end of the table top. The first side rail may be disposed between the first lip and the second lip, and the second side rail may be disposed between the first lip and the second lip. In addition, the table may include a first frame receiving portion disposed in the lower surface of the table top, the first frame receiving portion being sized and configured to receive at least a portion of the first side rail; and a second frame receiving portion disposed in the lower surface of the table top, the second frame receiving portion being sized and configured to receive at least a portion of the second side rail. If desired, the first frame receiving portion may have a generally inwardly extending curved surface; and the second frame receiving portion may have a generally inwardly extending curved surface. Additionally, the first side rail includes a curved upper surface and the second side rail includes a curved upper surface. The table may further comprise a first frame receiving portion disposed in the lower surface of the table top, the first frame receiving portion including a curved surface that generally matches the curved upper surface of the first side rail, the first frame receiving portion being sized and configured to receive the curved upper surface of the first side rail;

and a second frame receiving portion disposed in the lower surface of the table top, the second frame receiving portion including a curved surface that generally matches the curved upper surface of the second side rail, the second frame receiving portion being sized and configured to receive the curved upper surface of the second side rail.

If desired, the first lip may have a generally C-shaped configuration with a first portion disposed proximate the first side of the table top, a central portion disposed proximate the first end of the table top and a second portion disposed proximate the second side of the table top; and the second lip may have a generally C-shaped configuration with a first portion disposed proximate the first side of the table top, a central portion disposed proximate the second end of the table top and a second portion disposed proximate the second side of the table top. In addition, the table may comprise a first opening disposed between the first lip and the second lip on the first side of the table top, and a second opening disposed between the first lip and the second lip on the second side of the table top. Further, the first side rail may be disposed proximate the first opening and an outer surface of the first side rail is generally visible to a user when the table is being used, and the second side rail may be disposed proximate the second opening and an outer surface of the second side rail is generally visible to a user when the table is being used.

These and other aspects, features and advantages of the present invention will become more fully apparent from the following brief description of the drawings and the drawings themselves.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards a table with legs that are movable between an extended position and a collapsed position relative to a tabletop. The principles of the present invention, however, are not limited to tables with legs that are movable between extended and collapsed positions relative to a tabletop. It will be understood that, in light of the present disclosure, the table can have a variety of suitable shapes, sizes, configurations and arrangements. In addition, the table may have various parts, components and the like; and the table may be used for different purposes, functions, intended purposes, etc.

Additionally, to assist in the description of the table, words such as top, bottom, front, rear, right and left may be used to describe the accompanying figures. It will be appreciated, however, that the present invention can be located in a variety of desired positions—including various angles, sideways and even upside down. A detailed description of the table now follows.

Figure 1:
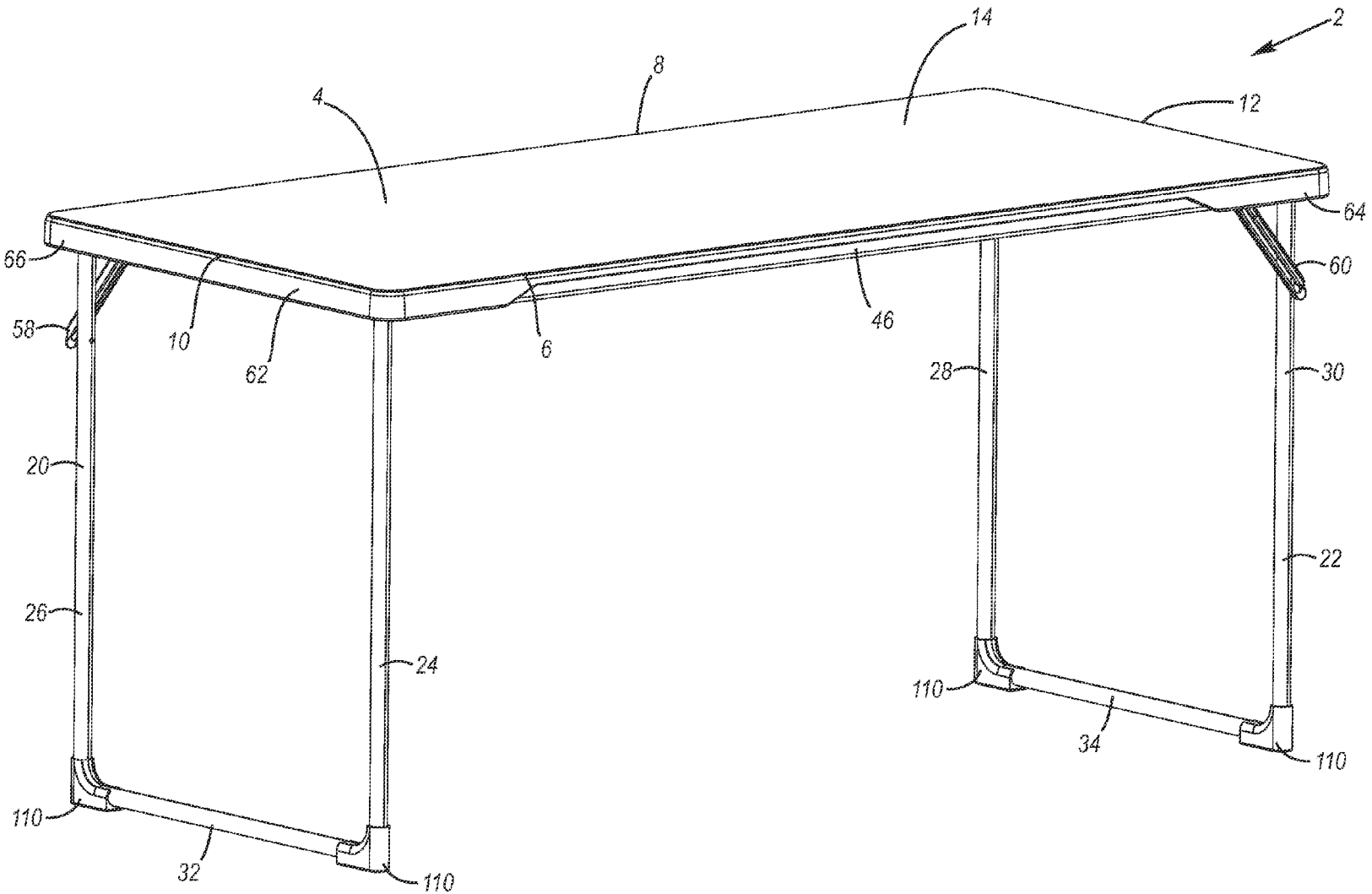
FIG. 1 is an upper perspective view of an exemplary table, illustrating the legs in an extended position.

As shown in FIG. 1, an exemplary embodiment of the table 2 includes a table top 4. The table top 4 is preferably constructed from a lightweight material such as plastic. In particular, the table top 4 can be constructed from plastic, such as high density polyethylene, but other materials with suitable characteristics may also be used to construct the table top. The plastic table top 4 is desirably formed by a blow-molding process because, for example, it may allow a relatively strong, lightweight, rigid and sturdy table top to be quickly and easily manufactured. In particular, the blow-molded table top 4 may be relatively lightweight because it may include a hollow interior that is formed during the blow-molding process. In addition, as discussed in greater detail below, the blow-molded plastic table top 4 may be constructed from less plastic than conventional plastic table tops, which may save manufacturing costs and reduce consumer costs. Further, the blow-molded table top 4 can be manufactured with relatively thin outer walls, which may allow the table top to cool more quickly during the manufacturing process and that may decrease both manufacturing time and costs.

The blow-molded plastic table top 4 can be constructed to form a variety of suitable shapes, configurations, sizes, designs and/or colors depending, for example, upon the intended use of table 2. For example, as shown in FIG. 1, the table top 4 can be constructed with a generally rectangular configuration and it may be used to create a utility type table. In particular, the table top 4 may include a first side 6, a second side 8, a first end 10 and second end 12. The table 2 may also have a length, such as about four, six or eight feet, and a width that is in the range of about two or three feet. One of ordinary skill in the art will appreciate that the table top 4 can have other suitable sizes to create a larger or smaller table top. In addition, one of ordinary skill in the art will appreciate that the table top 4 may have other appropriate configurations. For example, the table top 4 can have a circular configuration with a diameter ranging from about two to about six feet; or a generally square configuration with sides ranging from about two to about four feet in length. Of course, the blow-molded table top 4 can have any suitable shape, size, configuration and/or arrangement depending, for example, upon the intended use of the table 2.

The table top 4 is preferably constructed from blow-molded plastic because it may be durable, weather resistant and temperature insensitive. In addition, blow-molded plastic table tops 4 may be corrosion and rust resistant. Blow-molded plastic table tops 4 may also allow a long lasting table 2 to be created. One or ordinary skill in the art will appreciate that the table top 4 does not have to be constructed from blow-molded plastic and other suitable materials and/or processes can be used to construct the table top depending, for example, upon the intended use of the table 2. For example, the table top 4 could be constructed from other suitable types of plastic or other materials with appropriate characteristics. The table top 4 could be constructed using other processes such as injection molding, extrusion molding, compression molding and the like.

Figure 2:
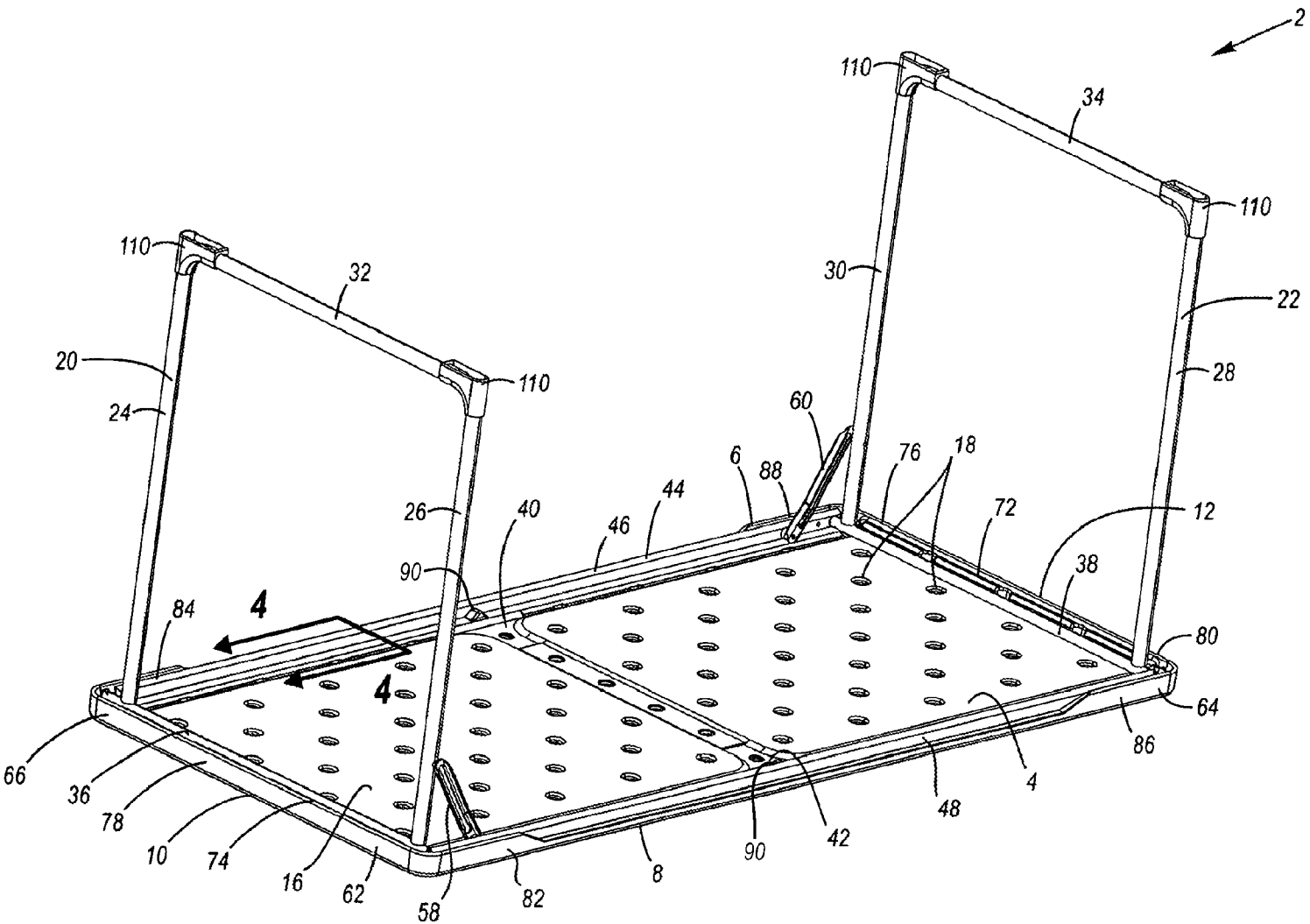
FIG. 2 is a lower perspective view of the table shown in FIG. 1.
Figure 3:
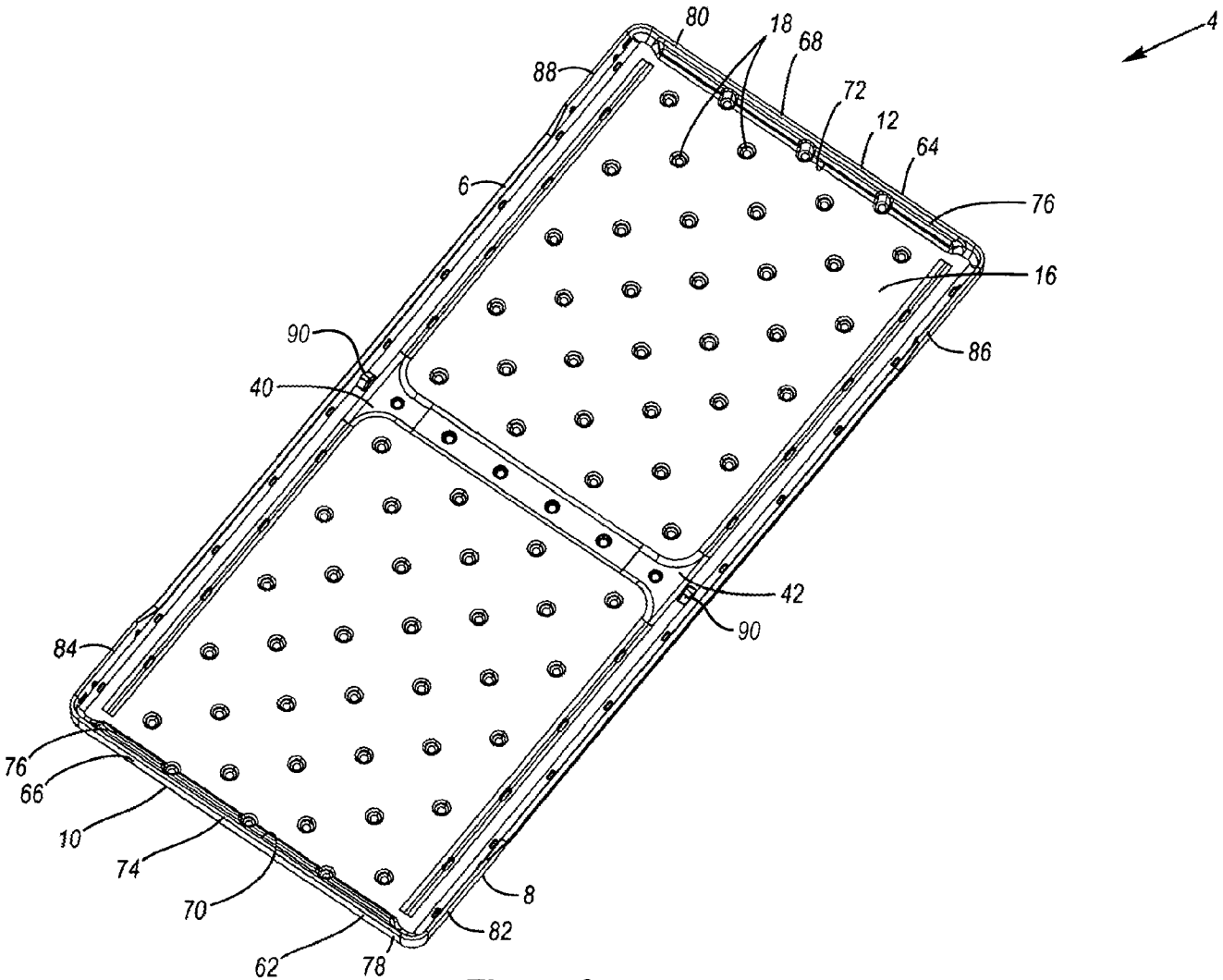
FIG. 3 is a lower perspective view of a portion table shown in FIG. 1.

As shown in the accompanying figures, the table top 4 preferably has a generally planar construction. For example, the table top 4 may have a generally planar upper surface 14, which may allow the table to be used in a wide variety of situations and environments. The table top 4 may also have a generally planar lower surface 16 that is spaced apart from the upper surface 14, and hollow interior portion may be disposed between the upper and lower surfaces. Preferably the upper surface 14 and the lower surface 16 are spaced apart by a generally constant distance and both the upper and lower surfaces have a generally planar construction. Advantageously, the generally planar upper 14 and lower surfaces 16 may allow the table top 4 to be quickly and easily manufactured, which may decrease the manufacturing costs of the table 2. Further, the generally planar upper 14 and lower surfaces 16 of the table top 4 may reduce the amount of materials required to construct the table top, which may also decrease the manufacturing costs of the table 2. Because the table 2 may be manufactured at lower costs, the may decrease the price of the table to the consumer. While the table top 4 preferably has a generally planar upper 14 and lower surfaces 16, the table top may include one or more inwardly or outwardly extending projections or portions. For example, as seen in FIGS. 2 and 3, the table top 4 may include one more inwardly extending depressions 18. In addition, as discussed in greater detail, the table top 4 could include one or more outwardly extending projections or portions that extend downwardly from the lower surface 16 of the table top 4.

If the table top 4 includes a generally planar upper surface 14 and a generally planar lower surface 16, then the table top may have a beam-type design. This beam-type design may help create a table top 4 with increased strength and/or reduce potential buckling of the table top. One of ordinary skill in the art will appreciate that the table top 4 may have other suitable types of design and construction depending, for example, upon the intended use of the table 2.

The table top 4 may include one or more features that are integrally formed in the table top as part of a unitary, one-piece structure. For example, as seen in FIGS. 2 and 3, the depressions 18 may be integrally formed in the table top 4 as part of a unitary, one-piece structure. The depressions 18 may be sized and configured to increase the strength and structural integrity of the table top 4. The depressions 18 may extend from one surface of the table top 4, such as the lower surface 16, to an opposing surface, such as the upper surface 14. The ends of the depressions 18 may contact or engage the opposing surface, but the ends of the depressions could also be spaced apart from the opposing surface. The depressions 18 may advantageously be sized and configured to increase the strength and/or structural integrity of the table top 4, which may allow the table top to be construed with thinner walls. Advantageously, this may decrease the amount of plastic to construct the table top 4. The thinner walls may also be used to create a table top 4 that cools faster during the manufacturing process, which may allow the table tops to be more quickly manufactured. In addition, this may allow a lighter weight table top 4 to be constructed, which may decrease the weight of the table 2. It will be appreciated that any suitable number of features many be integrally formed with the table top 4 as part of a unitary, one-piece structure. The features, however, do not have to be integrally formed with the table top 4 as part of a unitary, one-piece structure. Further, it will be appreciated that the table top 4 could have any suitable number of features depending, for example, upon the intended use of the table 2. The table 2 and/or the table top 4, however, does not require any particular features or number of features.

As shown in FIGS. 1 and 2, the table 2 may include one or more legs or leg assemblies 20, 22. The legs 20, 22 are preferably movable between an extended or use position in which the legs extend outwardly from the table top and a collapsed or storage position in which the legs are positioned proximate the lower surface 16 of the table top 4. As shown in the accompanying figures, the legs 20, 22 preferably have a generally U-shaped configuration. For example, the legs 20, 22 may include two generally parallel, elongated portions 24, 26, 28, 30, respectively, and a connecting portion 32, 34 that connects the elongated portions. The elongated portions 24, 26, 28, 30 and the connecting portions 32, 34 preferably have a generally straight configuration, but the elongated portions and/or the connecting portions may also be curved or have other suitable configurations. In addition, the connection of the elongated portions 24, 26, 28, 30 and the connecting portions 32, 34 is preferably curved or bent. Advantageously, this may allow the legs 20, 22 to be more easily manufactured. In addition, the connecting portions 32, 34 may help maintain the elongated portions 24, 26, 28, 30 in the desired positions and the connecting portions may help form legs 20, 22 that are stronger and/or more rigid. It will be appreciated that the legs 20, 22, including the elongated portions 24, 26, 28, 30 and connecting portions 32, 34, could have other suitable shapes, sizes, configurations and arrangements depending, for example, upon the intended use of the table 2.

As shown in the accompanying figures, the legs 20, 22 are preferably disposed at least proximate opposing ends of the table top 4. In addition, the elongated portions 24, 26, 28, 30 are preferably disposed such that the legs 20, 22 have a width that is approximately equal to or less than a width of the table top 4. Advantageously, if the elongated portions 24, 26, 28, 30 have a width about the same or slightly less than the width of the table top 4, then a sturdy table 2 may be constructed. It will be understood that the legs 20, 22 could be attached to any suitable portions of the table top 4 and the legs could have other styles or designs depending, for example, upon the intended use of the table 2.

As shown in FIG. 2, the legs 20, 22 may be connected to cross members or crossbars 36, 38, respectively. For example, the legs 20, 22 could be pivotally connected to the crossbars 36, 38 to allow the legs to be moved between the extended and collapsed positions. On the other hand, the crossbars 36, 38 could be pivotally connected to the table top 4. In addition, the crossbars 36, 38 could form part of the legs 20, 22 or the crossbars could be separate structures depending, for example, upon the intended use of the table 2. While the legs 20, 22 are preferably movable relative to the table top 4, the legs may remain in a fixed position if desired.

Advantageously, the generally U-shaped configuration may help the legs 20, 22 maintain the desired shape and configuration. In addition, the generally U-shaped legs 20, 22 may allow the table 2 to support a larger weight because the legs may be able to support a larger amount of force. Further, the connecting portions 30, 32 may help prevent the elongated portions 24, 26, 28, 30 from undesirably moving when a load is applied to the table 2. Additionally, the generally U-shaped legs 20, 22 are preferably constructed from relatively strong materials, such as steel, and may have a hollow tubular configuration, which may allow the legs to be lightweight. The legs 20, 22 may also be offset depending, for example, upon the size of the table top 4. The offset legs 20, 22 may allow the legs to have a longer length so that the table top 4 can be support at a greater height.

The generally U-shaped legs 20, 22 may also allow the legs to be quickly and easily attached and/or removed from the table 2. For example, because the table 2 may only include two legs 20, 22, the legs may be connected to the table in a relatively uncomplicated and straightforward manner. This may allow the table 2 to be assembled by the manufacturer, retailer and/or consumer. This may also allow the table 2 to be easily disposed in a shipping or storage configuration in which the legs 20, 22 are not connected to the table, and then disposed in a use position by attaching the legs to the table top 4.

When the legs 20, 22 are in the collapsed and/or shipping configuration, at least a portion of the legs may be disposed in one or more receiving portions form in the table top 4. For example, the table top 4 may include two leg receiving portions or recesses 40, 42 formed in the lower surface 16 of the table top 4. The leg receiving recesses 40, 42 are preferably sized and configured to receive at least a portion of table legs 20, 22 in the collapsed or storage position. Advantageously, this may facilitate stacking of the tables 2 and/or securing the table legs in the collapsed position.

The table 2 may also include a frame 44 and the frame may include one or more side rails. For example, the frame 44 may include two side rails 46, 48 that are disposed along the first and second sides 6, 8 of the table top 4, and the side rails preferably extend along at least a majority of the length of the table top 4. The side rails 46, 48 may be generally aligned with the sides 6, 8 of the table top 4 or spaced apart from the edges of the table top. In particular, the side rails 46, 48 are preferably spaced apart from and disposed parallel to the sides 6, 8 of the table top 4. It will be appreciated that the side rails 46, 48 may also be disposed in other suitable positions and locations depending, for example, upon the size and configuration of the table top 12.

The side rails 46, 48 are preferably disposed about the perimeter or outer edges of the table top 4. Advantageously, because the side rails 46, 48 may be disposed proximate the perimeter of the table top 4, the frame 44 may help support the edges or extremities of the table top. This may allow a stronger table 2 to be formed because the edges of the table top 12 may be supported by the frame 44. In addition, the frame 44 may help prevent damage to the table top 4. For example, the frame 44 may help prevent the table top 4 from undesirably bending or deforming if a force or sudden impact is applied to the table top.

If the side rails 46, 48 are disposed proximate the edges of the table top 4, then that may allow wider legs 20, 22 to be attached to the table 2. For example, if the side rails 46, 48 are disposed proximate the first and second sides 6, 8 of the table top 4, then the legs 20, 22 may have a width that is approximately equal to or slightly less than the width of the table top. Thus, the elongated portions 24, 26, 28, 30 of the legs 20, 22 could be disposed proximate the side rails 46, 48 and the sides 6, 8 of the table top 4; which would allow the elongated portions to be separated by a distance that is approximately equal to or slightly less than the width of the table top. Advantageously, because the legs 20, 22 may have a width that is approximately equal to the width of the table top 4, that may allow a sturdy and stable table 2 to be created.

Figure 5:
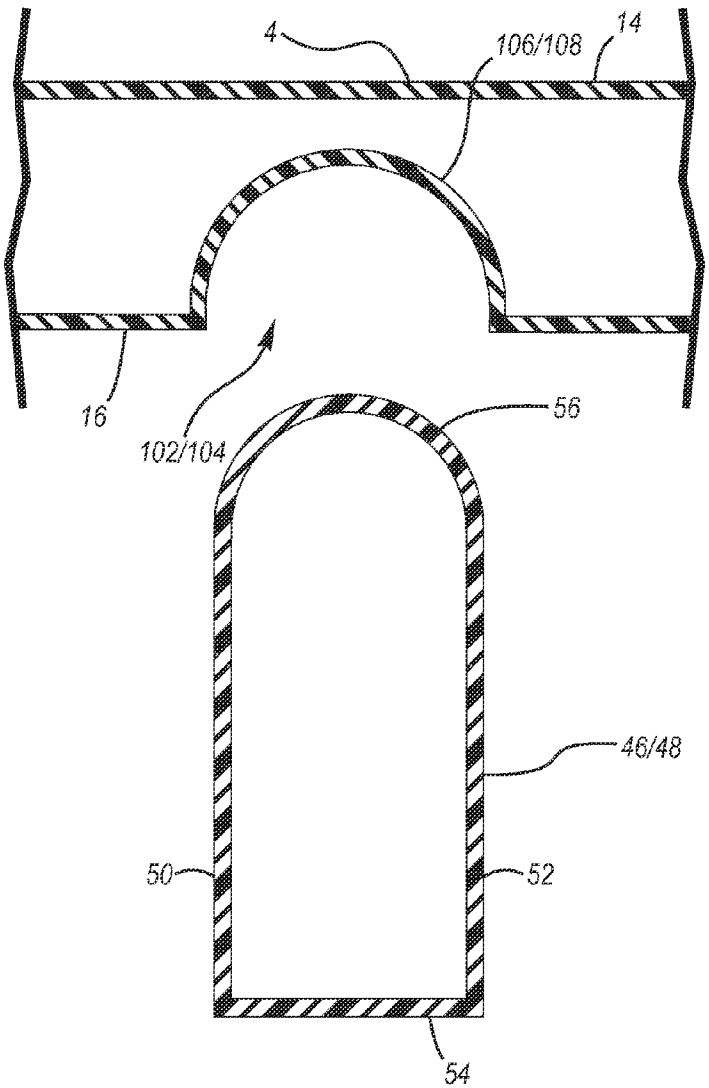
FIG. 5 is an exploded view of the portion of the table top and side rail shown in FIG. 4.
Figure 4:
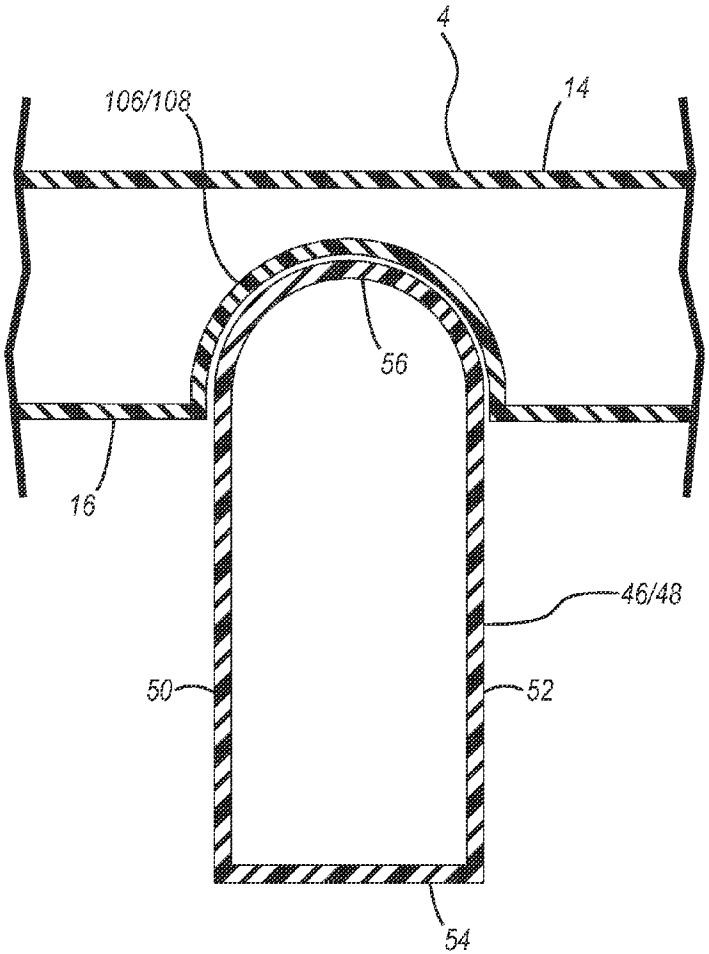
FIG. 4 is an enlarged, cross-sectional side view along lines 4-4 of a portion of the table shown in FIG. 2, illustrating a portion of the table top and side rail.

As best seen in FIGS. 4 and 5, the side rails 46, 48 preferably have a generally rectangular configuration with a first side wall 50, a second side wall 52, a lower wall 54 and an upper wall 56. The first side wall 50 and the second side wall 52 are preferably spaced apart by a generally constant distance and are disposed in generally parallel planes. The lower wall 54 is preferably disposed perpendicular to the first and second side walls 58, 60; and the lower wall preferably interconnects the first and second side walls. The upper wall 56 is preferably curved or arched. In particular, the upper wall 56 preferably extends outwardly and includes a rounded upper surface. The lower wall 54 preferably has a generally flat or planar bottom surface, which may facilitate stacking of the table 2. In addition, the generally planar lower wall 54 and/or the rounded upper wall 56 may help create a strong and/or rigid side rail 46, 48. The side rails 46, 48 preferably have a hollow configuration, which may reduce the weight of the frame 44. The side rails 46, 48, however, do not have to be hollow and the frame 44 may have other suitable shapes, sizes, configurations and arrangements depending, for example, upon the size or shape of the table top 4 and/or the intended use of the table 2.

The frame 44 may also include the crossbars 36, 38, which are preferably disposed proximate the ends 10, 12 of the table top 4. The frame 44, however, could include other connecting portions and the connecting portions could be spaced inwardly from the ends 10, 12 of the table top 4. The ends of the crossbars 36, 38 may be disposed within openings in the side rails 46, 48, which may allow the crossbars to be pivotally attached to frame. The crossbars 36, 38 may also be securely and/or integrally formed with the side rails 46, 48 to create a unitary, one-piece frame 44. Of course, the crossbars 36, 38 and the side rails 46, 48 do not have to be interconnected and the frame 44 could have other suitable shapes, sizes, configurations and arrangements depending, for example, upon the intended use of the table 2.

The frame 44 is preferably constructed from a relatively strong and rigid material, such as steel, because the frame may be used to support all or a portion of the table top 4. It will be appreciated, however, that the frame 44 could be constructed from other materials with suitable characteristics and the table 2 does not require a frame. In addition, while the frame 44 is preferably at least proximate the exterior portions of the table top 4, the frame could be connected to any desired portions of the table top.

As shown in FIGS. 1 and 2, braces may be used to connect the legs 20, 22 to the table 2. The braces are preferably slotted braces 58, 60 that include a first end connected to the leg 20, 22 and a second end connected to the side rails 46, 48 of the frame 44. Preferably, the first end of the brace 58, 60 is slidably connected to the legs 20, 22 and the second end is pivotally connected to the side rails 46, 48 of the frame 44. It will be understood the first end of the brace 58, 60 could be pivotally connected to the legs 20, 22 and the second end could be slidably connected to the frame 44, if desired. As shown in the accompany figures, a single brace 58, 60 may be connected to each of the legs 20, 22, respectively. It will be understood, however, that any suitable number of braces may be used and the braces may have other shapes, sizes, configurations and arrangements depending, for example, upon the intended use of the table 2.

The braces 58, 60 are preferably sized and configured to maintain the legs 20, 22 in the extended position. Specifically, the braces 58, 60 preferably lock the legs 20, 22 into the extended position and the braces may be used to lock the legs in the collapsed position, if desired. The braces 58, 60 may also help guide the legs 20, 22 between the extended and collapsed positions. In addition, the braces 58, 60 may be biased to help maintain the legs 20, 22 in a desired position. For example, the braces 58, 60 may be biased to maintain the legs 20, 22 in a locked position. The braces 58, 60 are preferably constructed from a relative strong material, such as metal. It will be appreciated that the braces 58, 60 may have a variety of suitable shapes, sizes, configurations and arrangements, such as shown in U.S. patent application Ser. No. 10/873,777, filed on Jun. 22, 2004, entitled Cover for a Brace, which is incorporated by reference in its entirety.

The table top 4 may also include one or more downwardly extending projections, such as a lip. In particular, the table top 4 may include a first lip 62 disposed proximate the first end 10 of the table top and a second lip 64 disposed proximate the second end 12 of the table top. The lips 62, 64 preferably have a generally rectangular configuration with outer walls 66, 68; inner walls 70, 72; and lower walls 74, 76, respectively. The outer walls 66, 68 are preferably disposed generally parallel to and aligned with an outer edge of the table top 4, and the inner walls 70, 72 are preferably spaced inwardly from the outer walls. The lower walls 74, 76 preferably have a generally planar configuration and are disposed perpendicular to the outer walls 66, 68 and inner walls 70, 72. If desired, the lower walls 74, 76 of the lips 62, 64 may be disposed generally parallel to the lower wall 54 of the side rails 46, 48. Advantageously, the generally planar lower walls 74, 76 may facilitate stacking and/or storage of the table 2. In addition, a hollow interior portion may be disposed within the lips 62, 64 and the hollow interior portion is preferably in communication with the hollow interior portion of the table top 4. Further, the lips 62, 64 are preferably integrally formed with the table top 4 during the blow-molding process as part of a unitary, one-piece structure. It will be appreciated that the lips 62, 64 may have other suitable shapes, sizes, configurations and arrangements depending, for example, upon the intended use of the table 2. For example, the lips 62, 64 could be spaced apart from the edges of the table top 4 and the lips could be disposed at an angle. It will also be appreciated that the lips 62, 64 do not have to be integrally formed with the table top 4 during the blow-molding process and the lips could be made by various processes and methods.

In greater detail, the lips 62, 64 preferably extends downwardly from the lower surface 16 of the table top 4 and include an end 78, 80 that is disposed proximate opposing ends 10, 12 of the table top 4. Each lip 54, 56 may also include sides 82, 84, 86, 88 that are disposed along opposing sides 6, 8 of the table top 4. Preferably the ends 78, 80 and sides 82, 84, 86, 88 are generally aligned with and disposed parallel to the corresponding edges of the table top 4. In addition, the lips 62, 64 preferably has a generally C-shaped configuration with an end 78, 80 and sides 82, 84, 86, 68, respectively. The lips 62, 64 are also preferably disposed only at the ends 10, 12 and corners of the table top 4. Further, there is preferably a space or opening between the lips 62, 64 disposed along the sides 6, 8 of the table top 4.

It will be appreciated that the lips 62, 64 may have other suitable shapes, sizes, configurations and arrangements. For example, the lips 62, 64 do not have to extend along the entire ends 10, 12 of the table top 4 and the lips do not have to be disposed at the corners of the table top. In addition, the table 2 may include any suitable number of lips or downwardly extending projections depending, for example, upon the size or shape the table top 4. As discussed in greater detail below, the lips 62, 64 are preferably sized and configured to allow at least a portion of the frame 44 to be exposed while the table 2 is being used.

As best seen in FIGS. 1 and 2, at least a portion of the frame 44 is preferably exposed and visible when the table 2 is being used. That is, when the table 2 is in the use position, at least a portion of the frame 44 is exposed and visible to the user. Accordingly, the frame 44 is preferably disposed relative to the table top 4 so that at least a portion of the frame is visible to the user. Desirably, at least a portion of the side rails 46, 48 are visible to a user. It will be appreciated that any desired portions of the frame 44 may be exposed or visible to the user. Advantageously, if a portion of the frame 44 is visible, then the contrast between the table top 4 and the frame may be used to create a stylish or fashionable table 2. For example, because the table top 4 and frame 44 may be constructed using different materials, textures and/or colors, a table 2 with a pleasing appearance may be created. In addition, the contrast between the table top 4 and the frame 44 may be used to create a table 2 with difference aesthetics.

Advantageously, if at least a portion of the frame 44 is exposed, that may create the impression, whether real or imaged, that the table 2 is relatively strong. In addition, if at least a portion of the side rails 46, 48 are disposed along the outer edges of the table top 4, then the frame 44 may provide increased support for the edges or extremities of the table top. Further, if the frame 44 is disposed along the outer edges of the table top 4, then the frame may help prevent the table top from being damaged. For example, the frame 44 may help absorb impacts or forces because it is disposed proximate the perimeter of the table top 4. Accordingly, the frame may also help protect the table top from being dented, damaged or broken.

The table top 4 may also be sized and configured to protect the frame 44. For example, as best seen in FIG. 2, the side rails 46, 48 of the frame 44 may be spaced slightly inwardly from the outer edges of the table top. With the edges of the table top 4 extending past the side rails 46, 48, the table top may help prevent to the frame 44. For example, the exposed surfaces of the frame 44 may be painted and/or have a finished surface, and even minor impacts can leave significant scars or other visible blemishes on such surfaces. Because the table top 4 may be constructed from durable, resilient materials, such as blow-molded plastic, the table top may help protect the frame 44 from damage. Thus, the table top 4 may be sized and configured to help minimize or otherwise reduce damage to the frame 44, which may help keep the table 2 looking like new.

In greater detail, as best seen in FIGS. 1 and 2, only a portion of the frame 44 may be visible when the table 2 is being used. In particular, the ends of the side rails 46, 48 may not be visible when the table 2 is being used. For example, the first lip 62 and the second lip 64 may hide or prevent the ends of the side rails 46, 48 from being seen when the table 2 is being used. Thus, the table top 4 may include downwardly extending lips 62, 64 that prevent a portion of the frame 44 from being seen when the table 2 is being used.

If desired, the frame 44 may be connected to the lips 62, 64. In particular, the ends of the side rails 46, 48 may be connected to the sides 82, 84, 86, 88 of the lips 62, 64 to attach the side rails to the table top 4. The side rails 46, 48 and frame 44, however, do not have to be connected to the lips 62. 64. In contrast, the side rails 46, 48 are preferably connected to the table top 4 in several discrete locations to structures that are independent from and spaced apart from the lips 62, 64. For example, as best seen in FIGS. 6 to 9, the side rails 46, 48 of the frame 44 are preferably connected to mounting members 90 that extend downwardly from the lower surface 16 of the table top 4. The mounting members 90 are preferably independent structures that are spaced apart from other mounting members and other portions of the table top 4. In particular, the mounting members 90 are preferably independent of and spaced apart from structures such as the lips 62, 64.

As seen in the accompanying drawings, a plurality of mounting members 90 may be disposed proximate opposing sides of the table top 4 and the mounting members may allow the side rails 46, 48 of the frame 44 to be connected to these discrete structures. Preferably, the side rails 46, 48 are only connected to the mounting members 90 and not other portions of the table top 4, but the side rails may be connected to other portions of the table 2 if desired. The mounting members 90 are preferably spaced inwardly and apart from the edges of the table top 4. The mounting members 90 are also preferably spaced so that the side rails 46, 48 of the frame 44 can be disposed in the desired positions. It will be appreciated that the mounting members 90 could be disposed in other locations depending, for example, upon the desired position of the frame 44.

Figure 6:
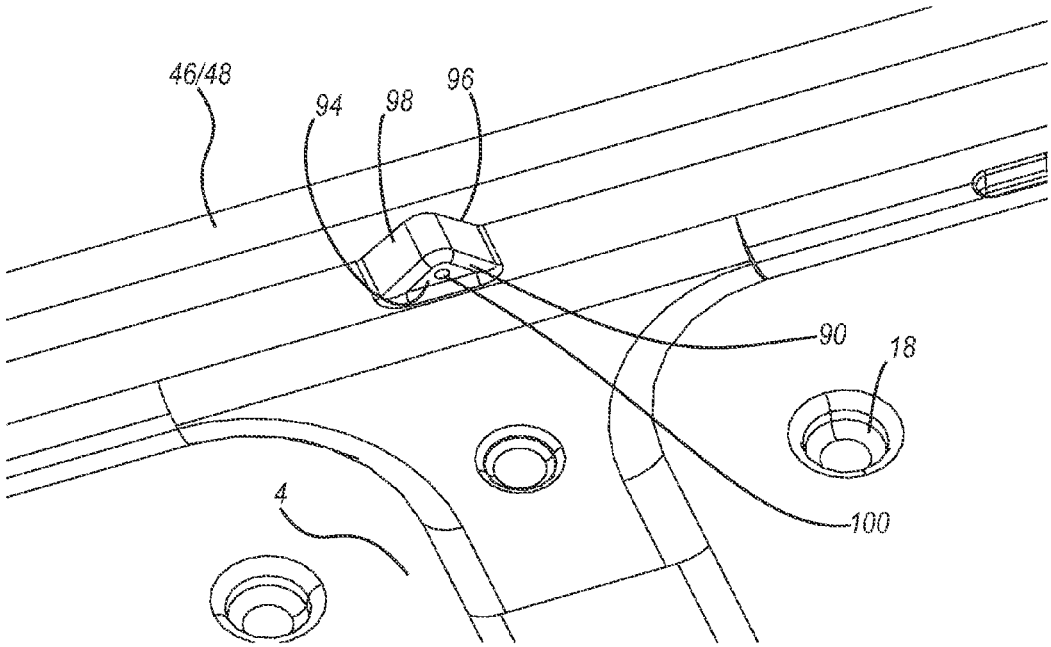
FIG. 6 is an enlarged, lower perspective view of a portion of the table shown in FIG. 1, illustrating a side rail and a mounting structure.
Figure 7:
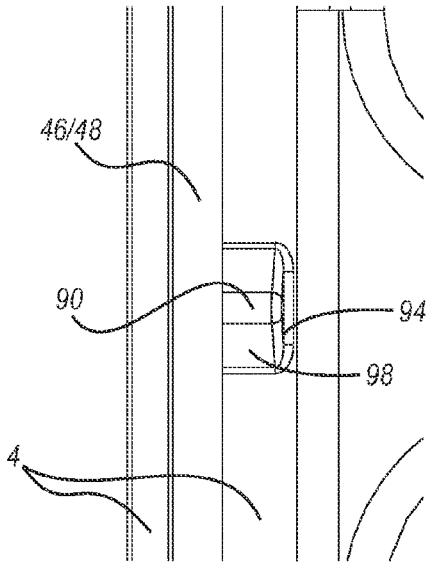
FIG. 7 is a bottom view of the portion of the table shown in FIG. 6.
Figure 9:
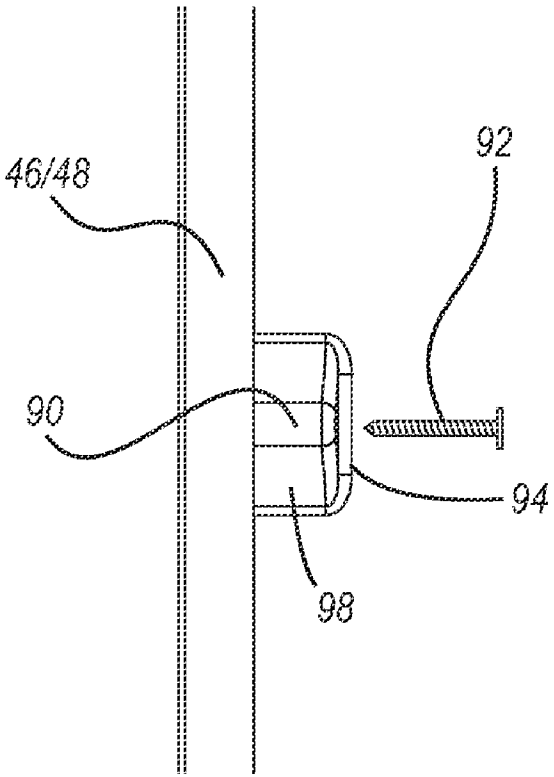
FIG. 9 is a partially exploded bottom view of the portion of the table shown in FIG. 8.
Figure 8:
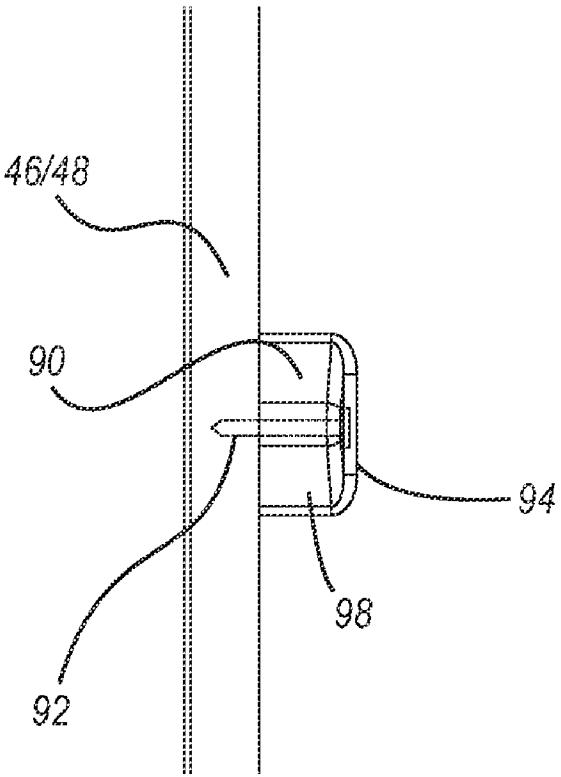
FIG. 8 is a bottom view of a portion of the table shown in FIG. 6, illustrating a fastener connecting the side rail and mounting structure.

The mounting members 90 are preferably sized and configured to allow the frame 44 to be connected to the table top 4 by fasteners 92, such as screws or bolts. For example, as best seen in FIGS. 6 and 7, the mounting members 90 may include two side walls 94, 96 and a curved outer surface 98. A hollow interior portion is preferably disposed between the side walls 94, 96 and the hollow interior portion is preferably in communication with the hollow interior portion of the table top 4. The mounting members 90 may include a receiving portion 100 that is sized and configured to receive a fastener 92. Preferably, the mounting members 90 are disposed such that the fastener 92 extends through both of the side walls 94, 96 and then into the side rails 46, 48 of the frame 44. The mounting members 90 may include a screw boss that is sized and configured to receive the fastener 92.

Significantly, the mounting members 90 may allow the frame 44 to be securely connected to the table top 4 because, for example, the fastener 92 may be inserted through the opposing side walls 94, 96. The side walls 94, 96 may help maintain the fastener 92 in a desired location and position. In addition, the mounting members 90 may be disposed towards an inner portion of the table 2 and the side rails 46, 48 of the frame 44 may be disposed towards the outer portion of the table. The side rails 46, 48 may be connected to the mounting members 90 such that the fasteners 92 are hidden from view when the table is being used. In particular, the fasteners 92 may be inserted through the mounting members 90 and into the inner side wall of the side rails 46, 48 so that the fasteners are generally not visible when the table 2 is being used. Advantageously, the mounting members 90 may be integrally formed with the table top 4 during the blow-molding process. It will be appreciated that the mounting members 90 may also be separate structures that are attached to the table top 4, if desired.

In greater detail, the connection of the frame 44 to the mounting members 90 is preferably hidden from view when the table 2 is being used. For example, as discussed above, the fasteners 92 preferably extend through the side walls 94, 96 of the mounting member 90 and are connected to the inner side wall of the side rails 46, 48 of the frame 44. The fasteners 92 preferably do not penetrate both side walls of the side rails 46, 48. That is, the fastener 92 preferably only extends through the inner side wall of the side rail and not through both side walls of the side rail. This may allow the fastener 92 to remain hidden from view while still allowing the side rails 46, 48 to be securely connected to the table top 4. It will be appreciated that the fastener 92 may extend completely through the side rails 46, 48, if desired, and the frame 44 could be connected to the mounting members 90 using other suitable structures and components.

As shown in FIGS. 4 and 5, the lower surface 16 of the table top 4 may include one or more receiving portions that are sized and configured to receive at least a portion of the frame 44. In particular, the table top 4 may include two frame receiving portions 102, 104 that are sized and configured to receive at least a portion of the side rails 46, 48 of the frame 44. As discussed above, the upper portion 56 of the side rails 46, 48 is preferably curved or arched and the receiving portions 102, 104 preferably include generally matching curved surfaces 106, 108 that are sized and configured to receive the upper curved portion of the side rails. In greater detail, the table top 4 may include generally concave frame receiving portions 102, 104 that are sized configured to receive the generally convex upper portion 56 of the side rails 46, 48. Desirably, if the table top 4 is constructed from blow-molded plastic, then the frame receiving portions 102, 104 may be integrally formed in the table top during the blow-molding process as part of a unitary, one-piece construction. Significantly, if the frame receiving portions 102, 104 are integrally formed as part of the table top 4, then the table top may have increased strength and/or structural integrity.

Because the frame receiving portions 102, 104 in the lower surface 16 of the table top 4 are preferably round, curved, arched and/or inwardly extending, that may allow the table top to be more easily constructed. In particular, the table top 4 may be more easily constructed from blow-molded plastic because the frame receiving portions 102, 104 may not include sharp corners or edges. In addition, the curved frame receiving portions 102, 104 may provide increased structural integrity and/or rigidity because the table top 4 may have a more consistent wall thickness. That is, both the curved frame receiving portions 102, 104 and the surrounding areas may have substantially the same wall thickness. Additionally, the curved frame receiving portions 102, 104 make allow the table top 4 to be constructed with fewer discontinuities and/or incongruities, which may help prevent weak spots. These factors, in addition to making the table top 4 easier to construct, may allow the table top to be constructed with decreased wall thickness. Specifically, the curved frame receiving portions 102, 104 may make the table top 4 to be more easily constructed from blow-molded plastic and/or to be constructed with thinner outer walls.

Advantageously, the upper wall 56 of the side rails 46, 48 preferably has a shape and dimensions that at least substantially match the shape and dimensions of the frame receiving portions 102, 204. Because at least a portion of the side rails 46, 48 may be disposed in the frame receiving portions 102, 104, that may help secure the frame 44 in a desired position and it may allow the table 2 to be more quickly and easily assembled. It will be understood that the frame 44 and frame receiving portions 102, 104 could have a variety of suitable configurations and arrangements. For example, the side rails 46, 48 could have a hollow, tubular configuration with a generally circular cross-sectional configuration. The receiving portions 102, 104 could have a corresponding configuration that is sized and configured to receive at least a portion of the side rails 46, 48. Thus, it will be appreciated that the side rails 46, 48 and/or the receiving portions 102, 104 may have other suitable shapes, sizes, configurations and/or arrangements depending, for example, upon the intended use of the table 2.

Because the table top 4 may only include two lips 62, 64 and the lips are only disposed about a portion of the perimeter of the table top, that may allow a substantial portion of the table top to not include a lip. In addition, because the frame 44 may only be connected to discrete mounting members 90 and only a limited number of mounting members may be required to attach the frame to the table top (such as four, six, eight, ten, etc), the lower surface 16 of the table top 4 may be generally planar with only a few downwardly extending projections. Because the table top 4 may include only a few downwardly extending projections, the lower surface 16 of the table top 4 may have generally uniform and consistent characteristics. This may also make the table top 4 easier to construct from blow-mold plastic.

As shown in FIGS. 1, 2, 10 and 11, a foot 110 may be connected to the legs 20, 22. Preferably, the foot 110 is connected to the leg 20, 22 by a snap, friction and/or interference fit. Advantageously, if the foot 110 is connected to the leg 20, 22 by a snap, friction and/or interference fit, then the foot need not be connected to the leg by fasteners, which may help reduce the amount of time required to construct the table and may reduce manufacturing costs. It will be appreciated, however, that the foot 110 may be connected to the leg 20, 22 with fasteners, adhesives and/or other suitable structures or means.

In greater detail, the foot 110 may be connected to a lower corner of the generally U-shaped leg 20, 22. For example, the foot 110 may be connected to the intersection of the elongated portion 24, 26, 28, 30 and the connecting portion 32, 34, which may help the foot from undesirably moving. In addition, at least a part of the foot 110 may extend beneath and/or past the elongated portions 24, 26, 28, 30, which may increase the stability of table 2 by, for example, creating a wider leg assembly. It will be appreciated that the table 2 and the leg 20, 22 may also have other suitable configurations.

Figure 11:
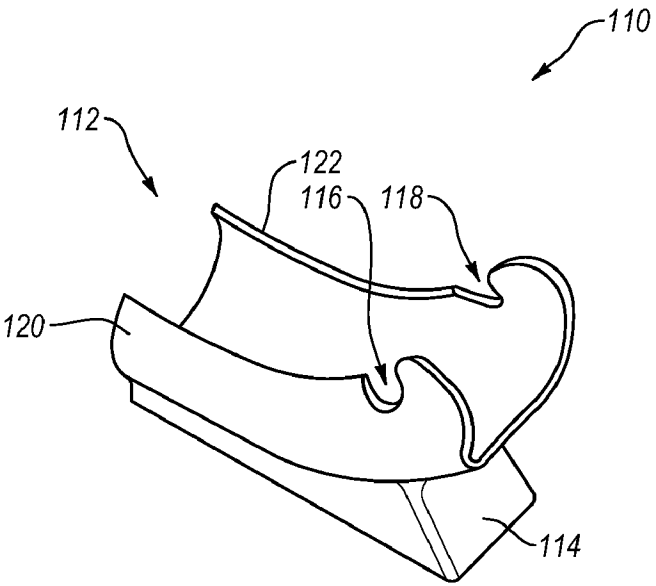
FIG. 11 is a perspective view of the foot shown in FIG. 10.
Figure 10:
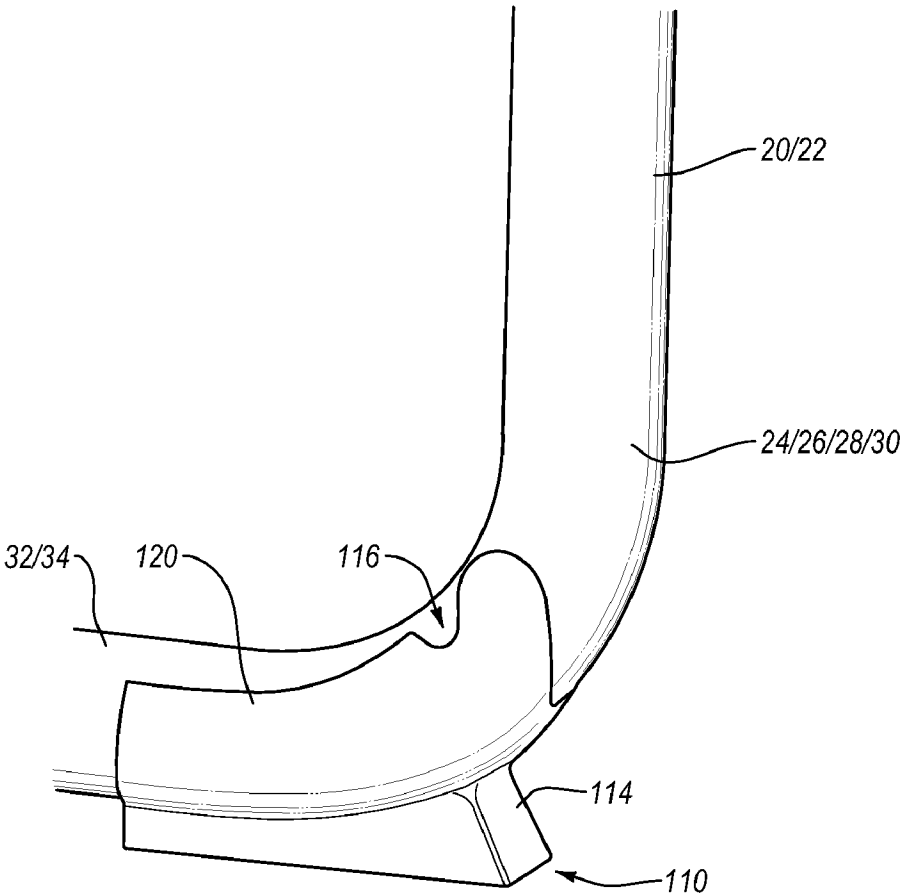
FIG. 10 is a perspective view of a portion of an exemplary table leg and an exemplary foot that may be used in connection with a table.

As best seen in FIGS. 10 and 11, the foot 110 may include a receiving portion 112 that is sized and configured to receive a portion of the legs 20, 22. The foot 110 may also include an outwardly extending portion 114 that is sized and configured to extend at least generally parallel to the outer surface of the leg 20, 22. The foot 110 may further include recesses notches 116, 118, which may be sized and configured to allow the foot to be securely connected to the legs 20, 22. In addition, the foot 110 may include a pair of spaced apart walls 120, 122 that at least partially define the receiving portion 112 that is sized and configured to receive and/or retain at least a portion of a leg with a snap fit, a friction fit and/or interference fit. The notches 116, 118 may also be sized and configured to relieve stress applied to the walls 120, 122 as the receiving portion 112 receives the leg 20, 22. Advantageously, the notches 116, 118 may help prevent the walls 120, 122 from undesirably cracking and/or breaking.

The foot 110 may help prevent the legs 20, 22 from moving or sliding, and the foot may help reduce wear and prevent damage to the legs. The foot 110 is preferably lightweight and constructed from relatively strong and resilient materials, such as plastic. The foot 110 may help create a table 2 with increased stability because it may provide a large contact area with a support surface. Further, the foot 110 may help create a stable table 2 because it may provide a larger stance for the legs 20, 22. The foot 110 preferably allows the legs 20, 22 to be folded against the lower surface 16 of the table top 4 when the legs are in the collapsed position. In addition, foot 110 may be easily replaceable and/or removable, if desired.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a table top including a first side, a second side, a first end, a second end, an upper surface and a lower surface;

a first plane generally aligned with the upper surface of the table top;

a second plane generally aligned with the lower surface of the table top, the first plane and the second plane being disposed in generally parallel planes and spaced apart by a generally constant distance;

a first leg disposed proximate the first end of the table top, the first leg being movable between an extended position and a collapsed position relative to the table top;

a second leg disposed proximate the second end of the table top, the second leg being movable between an extended position and a collapsed position relative to the table top;

a first lip extending downwardly from the lower surface of the table top, the first lip having a C-shaped configuration with a first portion disposed along the first side of the table top, a body disposed along the first end of the table top and a second portion disposed along the second side of the table top;

a second lip extending downwardly from the lower surface of the table top, the second lip having a C-shaped configuration with a first portion disposed along the first side of the table top, a body disposed along the second end of the table top and a second portion disposed along the second side of the table top;

a first elongated opening disposed between the first portion of the first lip and the first portion of the second lip, the first elongated opening having a length greater than at least one-half a length of the table top;

a second elongated opening disposed between the second portion of the first lip and the second portion of the second lip, the second elongated opening having a length greater than at least one-half the length of the table top;

a first frame mounting member extending downwardly from the lower surface of the table top and disposed proximate the first elongated opening;

a second frame mounting member extending downwardly from the lower surface of the table top and disposed proximate the second elongated opening;

a first side rail of a frame disposed proximate the first side of the table top and generally parallel to the first elongated opening, at least a majority of a length of the first side rail disposed proximate the first elongated opening; and a second side rail of the frame disposed proximate the second side of the table top and generally parallel to the second elongated opening, at least a majority of a length of the second side rail disposed proximate the second elongated opening;

wherein the first side rail is connected to the first frame mounting member portion proximate the first elongated opening;

wherein a portion of the first side rail, the first frame mounting member and the first portion of the first lip are aligned;

wherein the second side rail is connected to the second frame mounting member proximate the second elongated opening; and wherein a portion of the second side rail, the second frame mounting member and the second portion of the first lip are aligned.

2. The table as in claim 1, further comprising a plurality of depressions disposed in the lower surface of the table top and extending towards the upper surface of the table top.

3. The table as in claim 1, further comprising a first frame receiving portion disposed in the lower surface of the table top, the first frame receiving portion being sized and configured to receive at least a portion of the first side rail; and further comprising a second frame receiving portion disposed in the lower surface of the table top, the second frame receiving portion being sized and configured to receive at least a portion of the second side rail.

4. The table as in claim 3, wherein the first frame receiving portion has a generally inwardly extending curved surface; and wherein the second frame receiving portion has a generally inwardly extending curved surface.

5. The table as in claim 1, wherein the first side rail includes a curved upper surface; and wherein the second side rail includes a curved upper surface.

6. The table as in claim 5, further comprising a first frame receiving portion disposed in the lower surface of the table top, the first frame receiving portion including a curved surface that generally matches the curved upper surface of the first side rail, the first frame receiving portion being sized and configured to receive the curved upper surface of the first side rail; and further comprising a second frame receiving portion disposed in the lower surface of the table top, the second frame receiving portion including a curved surface that generally matches the curved upper surface of the second side rail, the second frame receiving portion being sized and configured to receive the curved upper surface of the second side rail.

7. The table as in claim 1, wherein the first frame mounting member is aligned with at least a portion of the first elongated opening; and wherein the second frame mounting member is aligned with at least a portion of the second elongated opening.

8. The table as in claim 7, wherein the first frame mounting member has a length less than the length of the first elongated opening; and wherein the second frame mounting member has a length less than the length of the second elongated opening.

9. The table as in claim 8, wherein an outer surface of the first side rail is generally visible to a user through the first elongated opening when the table is being used; and wherein an outer surface of the second side rail is generally visible to a user through the second elongated opening when the table is being used.

10. The table as in claim 1, wherein the first frame mounting member is part of a first plurality of frame mounting members extending downwardly from the lower surface of the table top, the first plurality of frame mounting members being disposed proximate the first side of the table top, the first plurality of frame mounting members being sized and configured to allow the first side rail to be attached to the table top, the first plurality of frame mounting members being independent from and distinct from other portions of the table top; and wherein the second frame mounting member is part of a second plurality of frame mounting members extending downwardly from the lower surface of the table top, the second plurality of frame mounting members being disposed proximate the second side of the table top, the second plurality of frame mounting members being sized and configured to allow the second side rail to be attached to the table top, the second plurality of frame mounting members being independent from and distinct from other portions of the table top.

11. A table comprising:

a table top;

a first leg movable between an extended position and a collapsed position relative to the table top;

a second leg movable between an extended position and a collapsed position relative to the table top;

a first lip extending downwardly from the table top and having a C-shaped configuration with a first portion disposed along a first side of the table top, a body disposed along a first end of the table top and a second portion disposed along a second side of the table top;

a second lip extending downwardly from the table top and having a C-shaped configuration with a first portion disposed along the first side of the table top, a body disposed along the second end of the table top and a second portion disposed along the second side of the table top;

a first elongated opening disposed between the first portion of the first lip and the first portion of the second lip, the first elongated opening having a length greater than at least one-half a length of the table top;

a first elongated side rail of a frame including an outer surface contacting an inner surface of the first portion of the first lip and contacting an inner surface of the first portion of the second lip;

a first frame mounting member extending downwardly from the lower surface of the table top, an outer surface of the first frame mounting member contacting an inner surface of the first elongated side rail of the frame; and a first fastener connecting the first side rail and the first frame mounting member, the first fastener, the first frame mounting member and the first elongated opening being aligned with an axis disposed along a width of the table top;

wherein a first end and a second end of the first frame mounting member are entirely disposed between an end of the first portion of the first lip and an end of the first portion of the second lip; and wherein the first frame mounting member has a length that is substantially less than the length of the first elongated opening.

12. The table as in claim 11, wherein the first fastener, the first frame mounting member and the first elongated opening are aligned with a center portion of the table top.

13. The table as in claim 11, further comprising a first frame receiving portion that extends inwardly from a lower surface of the table top, the first frame receiving portion including a first surface that engages a portion of the first side rail of the frame.

14. The table as in claim 11, wherein the first frame mounting member is part of a first plurality of frame mounting members, a first end of the first side rail sandwiched between the first portion of the first lip and one of the first plurality of frame mounting members, a second end of the first side rail sandwiched between the first portion of the second lip and one of the first plurality of frame mounting members.

15. The table as in claim 11, wherein the length of the first elongated opening is significantly greater than a majority of the length of the table top.

16. The table as in claim 11, further comprising a first frame receiving portion disposed in the lower surface of the table top, the first frame receiving portion including an inner surface that generally matches the outer surface of the first side rail, the first frame receiving portion being sized and configured to contact and abut the outer surface of the first side rail.

17. The table as in claim 11, wherein an outer surface of the first side rail is generally visible to a user when the table is being used.

18. The table as in claim 11, further comprising a plurality of depressions disposed in the lower surface of the table top and extending towards the upper surface of the table top.

19. The table as in claim 11, wherein the first frame mounting member is aligned with the first elongated opening.

20. The table as in claim 11, wherein the first frame mounting member has a length less than the length of the first elongated opening.

* * * * *

UNITED STATES PATENT AND TRADEMARK OFFICE

CERTIFICATE OF CORRECTION

PATENT NO. : 8,042,475 B2
APPLICATION NO. : 12/042310
DATED : October 25, 2011
INVENTOR(S) : Larcom et al.

It is certified that error appears in the above-identified patent and that said Letters Patent is hereby corrected as shown below:

Title Page, item (73), under "Assignee", in Column 1, Line 1, delete "Inc," and insert -- Inc., --, therefor.

Column 6, Line 26, delete "fusing" and insert -- using --, therefor.

Column 11, Line 29, delete "the may" and insert -- this may --, therefor.

Column 20, Line 57, in Claim 1, delete "member portion" and insert -- member --, therefor.

Signed and Sealed this
Twenty-fourth Day of April, 2012

David J. Kappos

David J. Kappos
*Director of the United States Patent and Trademark Office*